US006486822B1

(12) United States Patent
Peterman

(10) Patent No.: US 6,486,822 B1
(45) Date of Patent: Nov. 26, 2002

(54) CHEMICALLY MODIFIED RADAR ABSORBING MATERIALS AND AN ASSOCIATED FABRICATION METHOD

(75) Inventor: Douglas J. Peterman, Maryland Heights, MO (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 09/588,892

(22) Filed: Jun. 7, 2000

(51) Int. Cl.[7] ..... H01F 1/24
(52) U.S. Cl. ..... 342/1
(58) Field of Search ..... 342/1; 266/173

(56) References Cited

U.S. PATENT DOCUMENTS

| | | | |
|---|---|---|---|
| 3,938,152 | A | 2/1976 | Grimes et al. |
| 4,002,481 | A | 1/1977 | McKaveney |
| 4,006,479 | A | 2/1977 | LaCombe |
| 4,043,846 | A | 8/1977 | Amemiya et al. |
| 4,092,459 | A | 5/1978 | Deffeyes et al. |
| 4,137,361 | A | 1/1979 | Deffeyes et al. |
| 4,218,507 | A | 8/1980 | Deffeyes et al. |
| 4,360,384 | A | 11/1982 | McKaveney et al. |
| 4,474,606 | A | 10/1984 | McKaveney et al. |
| 4,731,191 | A | 3/1988 | Swihart |
| 4,882,224 | A | 11/1989 | Moro et al. |
| 5,147,718 | A | 9/1992 | Papoulias et al. |
| 5,332,619 | A | 7/1994 | Lacoste et al. |
| 5,407,498 | A | 4/1995 | Kemp |
| 5,552,455 | A | 9/1996 | Schuler et al. |
| 5,759,483 | A | 6/1998 | Kemp |
| 5,766,544 | A | 6/1998 | Kemp |
| 5,866,273 | A | 2/1999 | Wiggins et al. |
| 5,958,156 | A | 9/1999 | Kemp |
| 6,251,337 | B1 * | 6/2001 | Kane ..... 266/173 |

OTHER PUBLICATIONS

International Search Report, Dec. 12, 2001.

* cited by examiner

*Primary Examiner*—Daniel T. Pihulic
(74) *Attorney, Agent, or Firm*—Alston & Bird LLP

(57) ABSTRACT

Coated ferromagnetic particles are provided which are useful as radar absorbing material (RAM). In particular, ferromagnetic particles such as iron, carbonyl iron, cobalt, nickel, and alloys thereof are provided that have been coated with a protective non-conducting material such as silicon, silicon dioxide, aluminum oxide, and the like. The ferromagnetic particles are coated in a rotating retort containing a gaseous composition that deposits onto or diffuses into the particle. The coated particles of the present invention are particularly suitable for incorporation into RAM coating compositions intended for use in corrosive atmospheres.

22 Claims, 3 Drawing Sheets

CHEMICALLY MODIFIED RADAR ABSORBING MATERIALS AND AN ASSOCIATED FABRICATION METHOD

FIELD OF THE INVENTION

This invention generally relates to radar absorbing material (RAM). More specifically, the present invention relates to particulate RAM formed from a ferromagnetic core surrounded by a protective shell that shields the core from oxidation. The invention further relates to methods by which to produce such particulate RAM.

BACKGROUND OF THE INVENTION

Powders formed from ferromagnetic particles are widely used in radar absorbing applications. In particular, ferromagnetic materials characterized by poor conductivity (also referred to as lossy-dielectrics) are known for their ability to absorb microwave energy. Typically, such ferromagnetic particulates are incorporated into attenuating coating compositions that are spray painted onto the surface of a substrate to reduce its electromagnetic signature. It is known in the art that more efficient radar absorbing coating compositions approach the density provided by solid ferromagnetic materials, such as iron. Therefore, it is considered beneficial to employ the minimum amount of resin possible to provide cohesion to the coating and yet maintain separation among the ferromagnetic particles. It is important that the particles within the radar absorbing coating composition be kept separate because agglomerates of ferromagnetic particles become increasingly conductive, thus diminishing the ability of the coating composition to absorb microwave energy. Therefore, ferromagnetic particles having a non-conductive coating and which are further characterized by a uniform particle size distribution would be highly beneficial for use in radar absorbing coating compositions.

Iron has been used extensively as a ferromagnetic material in radar absorbing materials (RAMs), primarily because it provides both adequate shielding properties and is cost effective. However, the use of iron in either its pure or carbonyl form is generally considered problematic due to iron's tendency to form rust under normal environmental conditions. Rust causes the iron particles to lose their magnetic properties, and is therefore detrimental to shielding properties. Protective binders have been used to prevent rust, but most are not effective in protecting the RAM against the aggressive environments commonly encountered during use, such as salt spray environments and temperature extremes.

In alternative efforts to increase corrosion resistance, iron silicide alloys have been produced in powdered forms and used as RAM. Iron silicide powders do have improved corrosion resistance; however, their radar absorbing performance per weight and amount of iron is substantially less than that of either pure iron or carbonyl iron powders. Iron silicide coatings are noted in U.S. Pat. No. 4,137,361, in which conductive coatings are applied to iron particulates. Further, hybrid iron silicide particles, formed by diffusing silicon into carbonyl iron particulates, are also known, such as those disclosed in U.S. Pat. No. 5,866,273, hereby incorporated by reference in its entirety. However, the magnetic properties of carbonyl iron are superior to those of the bulk iron silicide particles provided by such hybrid structures. Further, the method used to produce such hybrid iron silicide particles forms a sintered mass that requires grinding prior to incorporation into coatings and the like. In addition to the added expense incurred by grinding, iron silicide is a more brittle material than pure or carbonyl iron, and thus the a mass of ground particles would be expected to provide a less uniform particle distribution.

Therefore, there remains a need in the art for ferromagnetic particles, in particular iron particles, having non-conductive coatings, particularly nonconductive coatings that further provide corrosion resistance. There is also a continuing need in the art for coated ferromagnetic particles having a uniform particle distribution which are additionally cost effective.

SUMMARY OF THE INVENTION

The present invention provides ferromagnetic particles having a non-conductive coating, for use in electromagnetic shielding applications and the like. In particular, the present invention provides ferromagnetic particles having a protective coating that provides both insulating properties and corrosion resistance to the particle without sacrificing the electromagnetic characteristics of the ferromagnetic material. As a result of the insulating characteristics imparted by the non-conductive coatings of the present invention, the robustness of RAM coating compositions employing conventional quantities of ferromagnetic filler is improved. Further, the non-conductive coatings of the present invention allow the use of higher loadings of ferromagnetic particles in RAM coating compositions, without inducing the conductivity issues normally encountered at comparable loadings of conventional ferromagnetic particles. The ferromagnetic particles of the present invention are further characterized by a uniform particle distribution and are produced without the need for additional grinding processes. This is particularly advantageous because it preserves the shape of the core particle. Thus, coated particles of the present invention may be provided in a variety of useful shapes, such as spheres, flakes, and fibers.

In one particularly advantageous embodiment, a coated particle capable of withstanding corrosive environments is provided which comprises a core formed from one or more layers of ferromagnetic material surrounded by a protective shell formed from one or more layers of a non-conducting material. In this advantageous embodiment, the protective shell is deposited onto the outer surface area of the core such that the protective shell shields the core from oxidation and further forms a substantially continuous non-conducting layer. The core may be comprised of a variety of ferromagnetic materials, including iron, carbonyl iron, cobalt, nickel, or alloys thereof. The protective shell may likewise be comprised of a variety of non-conducting materials, e.g. materials having a resistivity of grater than 2500 ohm-cm, including silicon, silicon oxide, chromium oxide, aluminum oxide, and mixtures thereof. Further, in advantageous embodiments of the present invention, the particulate core is substantially free of the non-conducting material that forms the protective shell, thereby providing a coated ferromagnetic particle whose shielding properties are comparable to an uncoated particle formed from the same ferromagnetic material. In one particularly advantageous embodiment, the protective shell has a thickness ranging from about 0.05 to about 20 microns. Coating compositions incorporating the coated particle of the present invention are also provided.

In additional advantageous aspects, the protective coating may be applied to the ferromagnetic particles of the present invention using a retort mounted about a generally horizontal axis of rotation. In such an advantageous embodiment, the retort is partially filled by placing a sufficient quantity of ferromagnetic particles into the empty retort, which is subsequently placed under vacuum. Following evacuation of the retort, a gaseous composition comprising one or more active elements to be deposited onto the surface of the ferromagnetic particles is introduced into the retort. In one preferred embodiment, the active elements contained within the gaseous composition are selected from the group consisting of silicon, chromium, aluminum, and oxygen. The use of a combination of silicon and oxygen as active elements is particularly advantageous because the silicon dioxide coating produced by such a combination has a low dielectric constant. Gases containing a combination of silicon and oxygen may be derived from, for example, silanes such as triethoxysilane, trimethoxysilane, and the like. Alternatively, in an additional beneficial embodiment, a further chemical treatment, such as an oxidation step or other chemical sealing step, may be applied to the coated particles to provide the desired continuous non-conductive coating. During and subsequent to introduction of the gaseous composition, the retort is rotated at a speed sufficient to fluidize the ferromagnetic particles and the temperature within the retort is elevated sufficiently to effect the deposition of the active element onto the ferromagnetic particles.

The present invention thus provides ferromagnetic particles coated with a protective shell. The protective shell is non-conductive, and thus provides insulative properties to the particle. In addition, the protective shell may impart corrosion resistance to the coated particle, without sacrifice to its radar shielding properties. The present invention further provides methods by which such coated ferromagnetic particles are formed.

Further understanding of the processes and systems of the present invention will be understood with reference to the brief description of the drawings and detailed description which follows herein.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. Further, the various control, monitoring, and electrical supply lines have been omitted throughout to improve clarity of presentation and understanding.

Figure 1A:
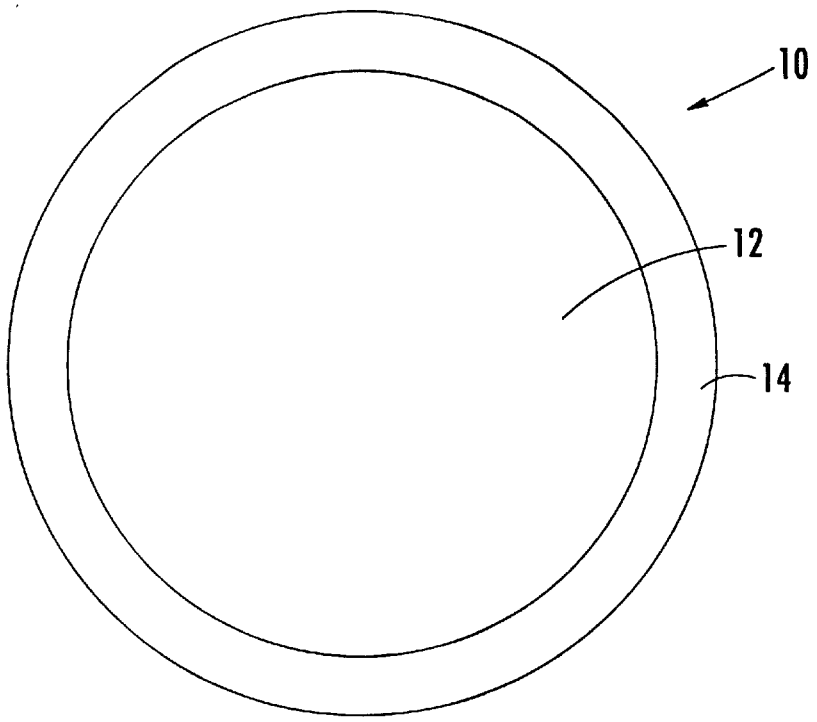
FIGS. 1A and 1B represent greatly enlarged cross-sectional views of coated ferromagnetic particles in accordance with various embodiments of the present invention.
Figure 1B:
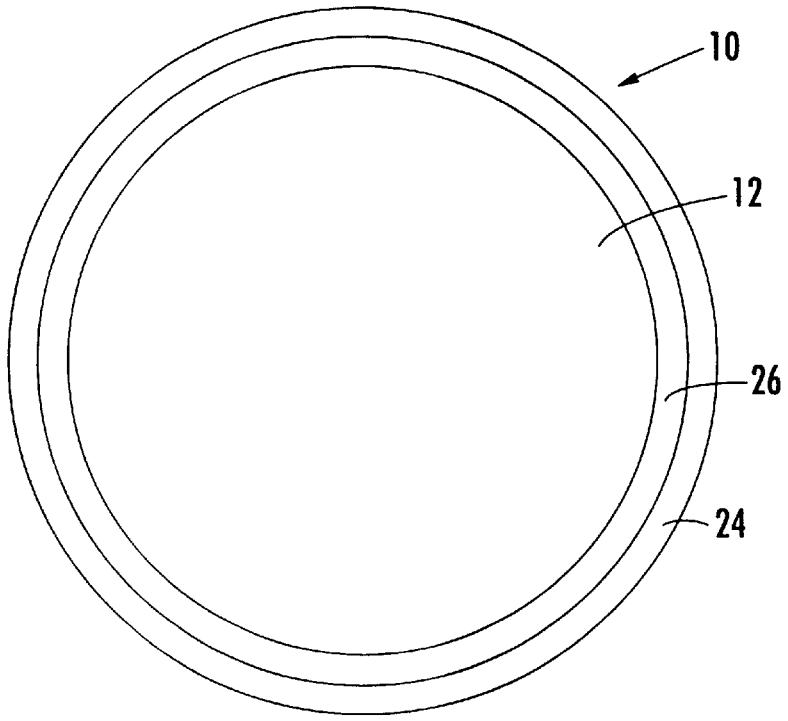

Referring now to FIG. 1, enlarged cross-sectional views of coated ferromagnetic particles prepared in accordance with the present invention are provided. FIG. 1A depicts a coated ferromagnetic particle 10 comprised of a core 12 surrounded by a protective shell 14. FIG. 1B illustrates a further aspect of the invention, in which a coated ferromagnetic particle 10 is formed from a core 12 surrounded by a multilayered protective shell 24, 26.

Figure 2:
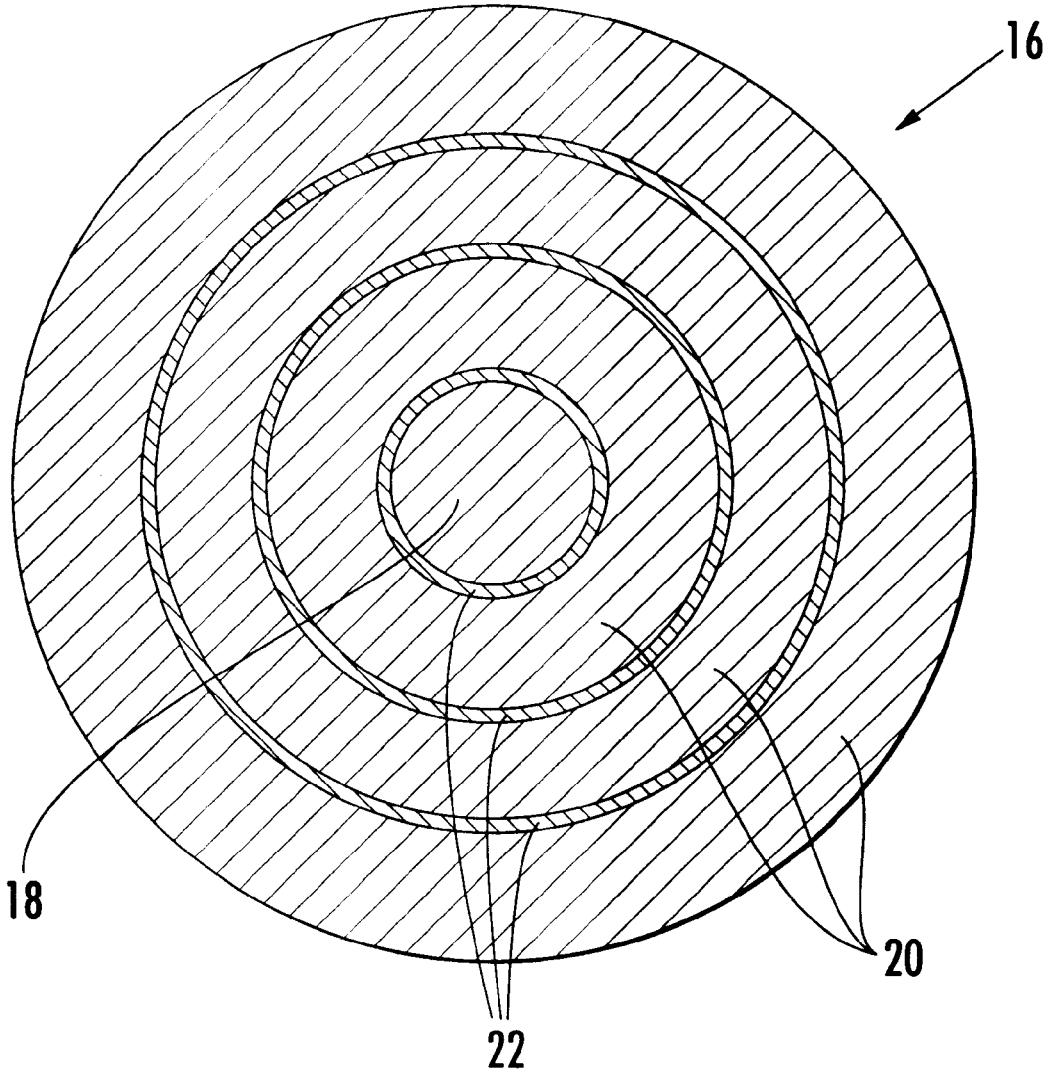
FIG. 2 represents a greatly enlarged cross-sectional of a carbonyl iron particle suitable for use in advantageous aspects of the present invention.

The core may be formed from any suitable ferromagnetic material. In particular, the core can be formed from iron, carbonyl iron, cobalt, nickel, or alloys thereof. The core may be further comprised of a single layer or multiple layers. In one particularly advantageous aspect of the present invention, carbonyl iron is employed as the core 12. Carbonyl iron particles are commercially available, and an enlarged cross sectional view of a carbonyl iron particle useful in the present invention is provided in FIG. 2. Carbonyl iron particles are generally made in a process which results in a multilayered particle comprised of a center region 18 surrounded by concentric spheres 20 of magnetic material that usually contain iron. The concentric spheres 20 appear in photomicrographs to be separated by very thin shells 22 of carbon compounds and other impurities. Relatively economic carbonyl iron powder can be obtained having <1% carbon, <0.5% oxygen, and 0.1% nitrogen as impurities. Although not wishing to be bound by theory, the shells 22 seem to separate magnetic domains within the carbonyl iron particle 16 and produce desired radar absorbing performance. Carbonyl iron particles are more thoroughly discussed in U.S. Pat. No. 5,866,273, which has been incorporated by reference. In a further alternative aspect, the core may be a hollow ferromagnetic particle.

Returning now to FIG. 1, the core 12 may have a diameter ranging from about 1 to about 250 microns. In other advantageous embodiments, the particle forming the core may have a powder size ranging from 200 mesh to 500 mesh (i.e. below 10 microns with an average size of 5 microns). When so sized the coated particle will remain suspended in a binder a sufficient amount of time to provide a useful pot life, even when low viscosity binders are used to form RAM coatings. When three dimensional parts are to be cast from a polymer loaded with the coated particles of the present invention, a larger particle size, for example up to 250 microns, may be preferred to obtain the desired loading.

A variety of materials may also be used to form the protective shell 14 of the coated particle 10. For example, protective shells may be formed from materials such as silicon, chromium, aluminum, oxygen and alloys thereof. In further embodiments, the protective shell may be an alloy of such material with the core material. Once formed, the protective shell may be subjected to further treatments, such as oxidation and the like, to chemically alter the some or all of the material comprising the protective shell 14. In those embodiments in which only a fraction of the protective shell is chemically altered by the subsequent treatment, a multilayered protective shell is formed having outer 24 and inner 26 layers of differing composition, such as that as depicted in FIG. 1B.

In particularly advantageous aspects of the present invention, the material forming at least the outer layer of the protective shell is non-conductive. As known in the art, materials may be broadly classified by their electrical properties, as defined in terms of their resistivity. As defined herein, conductive materials have a resistivity of less than about 2500 ohm-cm. Conversely, non-conductive materials are those having a resistivity of greater than about 2500 ohm-cm. The non-conductive materials of the present invention may be further categorized as either insulators or semiconductors. As further known in the art, the electrical properties of semiconductors lie approximately between that of conductors and insulators, thereby providing insulative properties in comparison to traditional conductive materials. Exemplary conductive materials include iron alloys such as iron silicide and iron aluminide. Known semiconductors include carbon, silicon, germanium, and tin. Exemplary insulators include a variety of oxides, including silicon dioxide, aluminum oxide, and chromium oxide. The use of non-conductive materials in the protective shell is advantageous for several reasons. For example, in RAM coating compositions the non-conductive coating insulates the ferromagnetic particles from each other, thereby avoiding the formation of conductive properties typically noted for ferromagnetic agglomerates, and detrimental to microwave absorption. Further, a continuous layer of these non-conductive coatings protects the ferromagnetic core from oxidation.

In one particularly advantageous embodiment of the present invention, silicon is used to provide the protective layer 14, shown in FIG. 1. In another aspect of this embodiment, the silicon is subjected to oxidation, thus providing a protective shell 14 formed from silicon dioxide. In a further aspect of this embodiment only the outermost region of the silicon protective shell is oxidized, thus producing a multilayered protective shell such as provided in FIG. 1B in which the outer layer of the protective shell 24 is comprised of silicon dioxide and the inner layer of the protective shell 26 is comprised of silicon. Alternatively, a protective shell 14 comprised of silicon dioxide may be deposited directly onto the core 12. For example, a protective shell 14 of silicon dioxide may be deposited from a gaseous composition comprising one or more silanes.

Protective shells produced using the methods of the present invention may be quite thick. In fact, protective shells having thicknesses of up to 50 microns are possible. However, in especially beneficial aspects of the present invention, the protective shell is thin, ranging in thickness from about 0.05 to about 20 microns. In other beneficial embodiments, and protective shell having a thickness of about 0.5 microns is formed. In one particular advantageous embodiment, a protective shell of about 0.2 microns in thickness is coated onto a spherical ferromagnetic powder having a diameter of about 5 microns. Although not wishing to be bound by theory, the use of thinner protective shells is generally considered beneficial in many aspects of the present invention, as the presence of the protective shell can interfere with the ferromagnetic properties provided by the core, especially for small powders. Conversely, for larger powders, thicker coatings may provide enhanced electrical properties due to the desirable dielectric properties of the coating. In especially advantageous embodiments, the thickness of the protective coating is chosen such that the ferromagnetic properties of the coated particles are unchanged in comparison to those of the core, e.g. the ferromagnetic properties are comparable to an uncoated particle of a comparable size and shape formed from the same ferromagnetic material. In particular, coated particles are provided which have a Curie point approximately equal to the Curie point of the core. For example, protective shells having a thickness of about 0.2 microns may be provided.

On a volume basis the protective shell typically occupies from about 1 to about 20% of the total volume of the coated ferromagnetic particle. The process of the present invention provides a controlled process by which to apply protective coatings. In particular, the process of the present invention allows thicker coatings to be applied to the surface of ferromagnetic particles, as well as coatings having better continuity. In particular, in one advantageous embodiment, the protective shell forms a substantially continuous layer that surrounds the core. Stated differently, the protective shell may be coated onto about 100% of the outer surface area of the core, thereby completely encapsulating the core. The thickness of the protective shell may be highly uniform as well.

Greater uniformity in the coverage and thickness of the protective shell surrounding the ferromagnetic core may be considered beneficial in various RAM applications. For example, greater uniformity in coverage, i.e. increased coating continuity, provides increased protection to the ferromagnetic core. This expected superior uniformity is due in great part to the process used to prepare the coated particles of the present invention. In general, the process of the present invention employs a gaseous composition containing one or more active elements to coat ferromagnetic particles with a protective shell. In particular, the protective shell is formed by bringing the gaseous composition and ferromagnetic particles into intimate contact in a tumbling, heated retort. During contact, the gaseous composition deposits one or more of the active elements onto the surface of the particle. Thus in the present invention the particulates are kept in constant motion, that is, fluidized, during the entire coating process. The use of a gaseous coating composition in combination with the fluidization of the particulates ensures intimate contact between the ferromagnetic particulates and the active elements. Further, the intimate contact, and subsequent coating, occurs around the complete circumference of the ferromagnetic particle. Such intimate and extensive contact has not heretofore been disclosed in the production of RAM particulates. As used herein, coating is used in its broadest sense unless otherwise noted; therefore, the term incorporates coatings formed both by diffusion and deposition.

Figure 3:
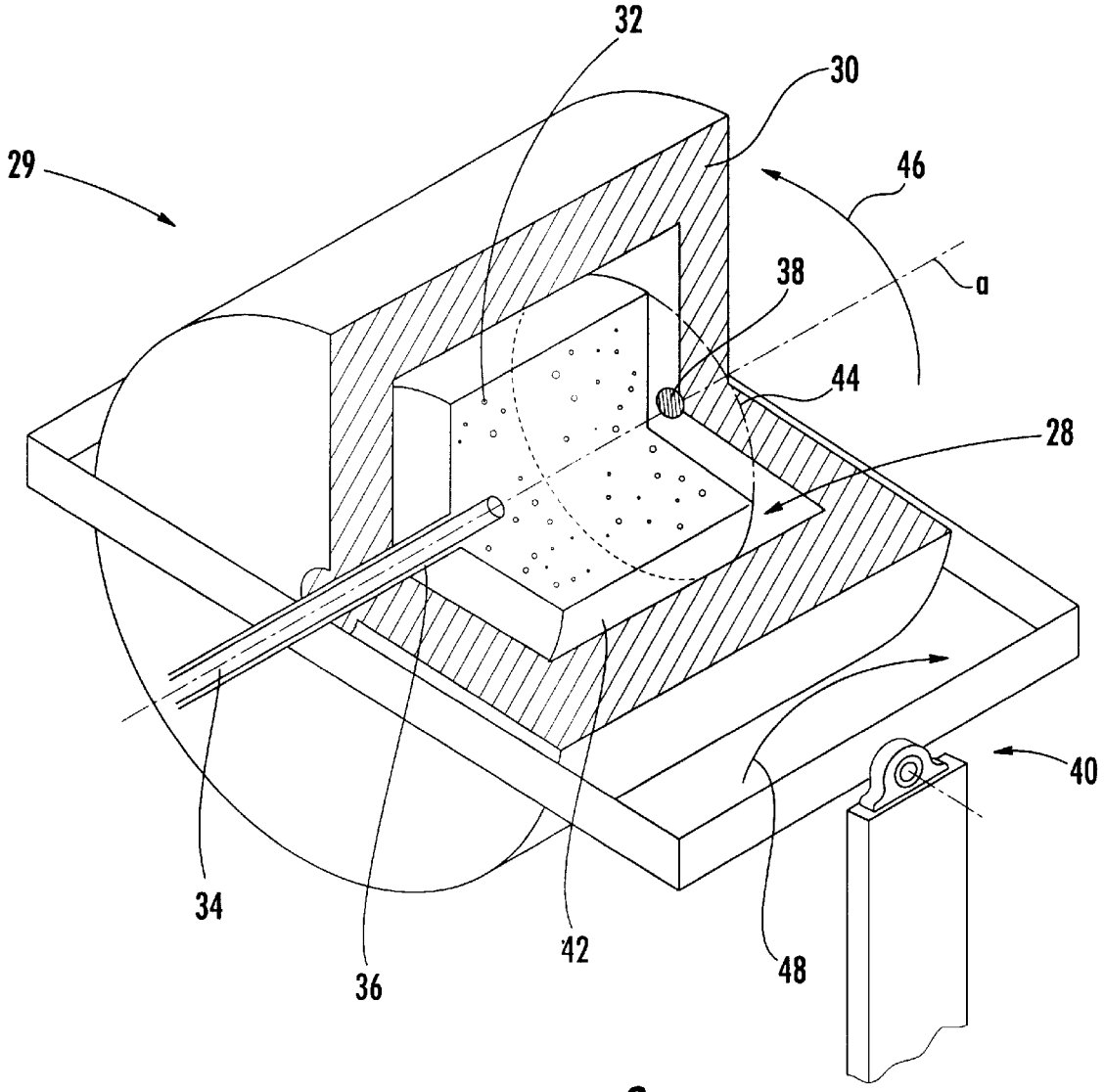
FIG. 3 represents a cutaway schematic drawing of a coating apparatus in accordance with one embodiment of the present invention.

A schematic of an apparatus suitable for use in the method of the present invention is provided in FIG. 3, which generally depicts a coating unit 29 comprised of a rotatable retort 28 housed within a heating jacket 30. The rotatable retort 28 is generally comprised of an outlet tube 36, an outer wall 42, and a bottom wall 44. In the advantageous embodiment provided in FIG. 3, the retort 28 is generally cylindrical in shape. The rotation of the retort 28 within the heating jacket 30 fluidizes the particles 32 to be coated. A conduit 34 for the ingress and egress of various gases is further provided within the outlet tube 36 of the retort 28, so that the atmosphere within the retort can be controlled while the retort is heated and rotated. Additional inlet and outlet conduits for the transport of gaseous compositions to and from the retort 28 are contemplated as well. Further, a sealable port 38 is provided in the bottom wall 44 to allow the retort 28 to be charged with particles. The retort spins about the axis denoted as "a", as indicated by arrow 46. The coating unit 29 is generally operated in a horizontal position; however, the precise angle of the coating unit 29 may be adjusted by means such as pivot 40, as indicated by arrow 48. An apparatus and process suitable to prepare the coated particles of the present invention are more fully described in U.S. Pat. No. 5,407,498 to Kemp, hereby incorporated by reference in its entirety.

In the method of the present invention, ferromagnetic particles are loaded into the retort, which is subsequently evacuated. The retort may be filled with particulates at exemplary levels up to about 60% of its volume. In an alternative embodiment, the retort is filled with a mixture of ferromagnetic and inert particles.

A gaseous composition containing one or more active elements to be coated onto the surface of the ferromagnetic particle is supplied to the evacuated retort. The gaseous composition is supplied at a selected, controlled pressure. Typically, a sufficient quantity of the gaseous composition is supplied to deposit a protective shell onto the surface of the ferromagnetic particle having a thickness of at least about 0.5 microns. However, in alternative embodiments, a sufficient quantity of gaseous composition is supplied to provide the active element in an amount sufficient to diffuse partway or throughout the entire diameter of the ferromagnetic particle. Many diffusion reactions are exothermic in nature, and caution must be taken to avoid overheating as well as the attendant formation of agglomerates.

One or more of a number of active elements may be contained within the gaseous composition. For example, the gaseous composition may contain active elements such as silicon, chromium, aluminum, oxygen, and mixtures thereof. As defined herein, active elements refer to those elements within the gaseous composition which either diffuse into or deposit onto the surface of the ferromagnetic particle, thereby coating it. In beneficial aspects of the present invention, the gaseous composition contains one or more silane gases, such as triethoxysilane, trimethoxysilane, tetraethoxysilane, and the like. In further aspects of the invention, any suitable gaseous composition containing a mixture of active elements such as one or more silicon containing compounds and one or more oxygen containing compounds may be employed. In particular, commercially available compositions in the form of silanes or siloxanes such as those available from Gelest, Inc., are suitable for use in the present invention. In other advantageous aspects, gaseous compositions containing one or more gases selected from the group consisting of $SiH_4$, $SiF_4$, and $SiCl_4$ are employed. The gaseous composition of the present invention may further be formed by the reaction of a sufficient quantity of silicon powder with a sufficient quantity of an activator, such as NaF, to form silicon gases, such as $SiF_4$. The gaseous composition may also contain inert gases, i.e. the carrier gases, comprised of nitrogen, argon and the like.

Returning now to FIG. 3, the retort 28 is rotated as the gaseous composition is supplied, at a speed sufficient to fluidize the ferromagnetic particles 32. Exemplary rotation speeds include speeds ranging from 5 to 40 rpm, dependant upon the particle size, particle shape, and the like. The temperature within the retort is elevated as it is rotated, to facilitate diffusion or deposition of the active element into or onto the ferromagnetic particle. In particular, the walls of the retort 42,44 are heated via the heating jacket 30. The energy supplied to the walls of the retort is subsequently transferred to the gaseous composition and the ferromagnetic particles 32. The energy so supplied thus effects, or triggers, the diffusion or deposition of the active element contained in the gaseous composition into or onto the surface of the ferromagnetic particle. The energy required to adequately promote the coating process is a function of the active elements and ferromagnetic particles employed.

Exemplary temperatures may fall within the range of from about 100 to about 800° C.

Further, other control processes may be useful in conjunction with the coating process of the present invention. In particular, thermocouples and cooling lines may be beneficially employed in conjunction with the coating unit of the present invention, as is known in the art.

The coating process of the present invention may be performed as either a one or two step process to obtain a non-conductive coating. In particular, a single pass of the coating method described above may be appropriate for those embodiments in which the ferromagnetic material is coated using a gaseous composition that includes oxygen as an active element. Specifically, coated particles having protective shells formed from such single pass oxide coatings are suitable for direct use in corrosion resistant applications. For example, if a gaseous composition is selected to have a combination of active elements such that silicon dioxide is deposited onto the surface of the ferromagnetic particles, the resulting single pass coated particles may be used directly in corrosive RAM applications. In other aspects, multiple coating processes may be employed to tailor the properties of the final coated particle. For example, ferromagnetic particles coated with silicon, aluminum and the like may be produced in an initial treatment within the coating unit 29. The coating unit 29 may be then used again following the procedures outlined above, this time to oxidize the surface of the previously coated particles. Oxidizing gases suitable for use the coating unit 29 include air. For example, aluminum may initially be deposited onto the surface of a ferromagnetic particle using the coating unit 29 and following the methods described above. This aluminum coating may subsequently be oxidized in either a second treatment within the coating unit 29 or in any oxidizing process known in the art. In a further example, ferromagnetic particles coated with silicon can be oxidized by treating the silicon coated particle in air at a temperature of about 1200° F. for a period of about 2 hours. In additional beneficial embodiments, further chemical treatments may be applied to the coated particles, such as applying additional non-insulative coatings and the like. Such further chemical treatments may be applied using the methods of the present invention or any other method known in the art.

The coated particles of the present invention are suitable for use in a various RAM applications. For example, the coated particles of the present invention may be added directly to RAM coating compositions and the like. The coated particles of the present invention are particularly attractive for use in RAM coating compositions because they do not require grinding prior to incorporation. Further, as noted previously, the insulative properties provided by the protective shell make the coated particles of the present invention highly beneficial in RAM coating compositions. In one particularly advantageous embodiment, a RAM coating composition is formed by incorporating the coated particles of the present invention into a polymeric binder. The polymeric binder is generally present in an amount sufficient to bind the coating together. The polymeric binder may additionally be present in amounts sufficient to maintain the coated particles substantially separate from each other. For example, the coated particles may be incorporated into coating compositions in amounts ranging up to about 85 wt %, particularly ranging from about 10 to about 80 wt %. In beneficial aspects of the invention, the polymeric binder may be a polyurethane. In a further advantageous aspect, the RAM coating composition also contains conductive particles, such as carbon powders and the like.

Further, the coated particles of the present invention may also be incorporated into other polymeric materials, to form three dimensional articles such as gaskets and the like. The coated particles of the present invention are particularly suitable for use in articles which are required to withstand corrosive environments.

The present invention will be further illustrated by the following non-limiting examples.

EXAMPLES

Carbonyl iron particles having a mean diameter of about 8 microns were loaded into the retort of a mechanical fluidized vacuum machine from ACTON Materials, Inc and coated using a tetraethoxysilane gas from Petrarch, a division of United Chemical Technologies to deposit a silicon dioxide coating. The resulting coated powder, which had a slight amount of agglomeration, had an apparent mean diameter of 11 microns. (This number may be somewhat deceptive in that increased agglomeration leads to an apparent increase in mean diameter.) Examination of the powder by use of scanning Auger electron spectroscopy revealed that the powders were sufficiently coated to cause them to become electrically charged under the influence of the probing electron beam. This behavior is consistent with the presence of a thick, e.g. greater than 0.1 microns, insulating coating. In fact, the silicon dioxide coating present on the surface of the carbonyl iron particle was approximately 1.2 microns in thickness.

The resulting coated particles were analyzed for coating continuity using thermogravimetric analysis (TGA), an analytical method that indicates the change in weight of solid samples heated in an air environment. For the purposes of the present invention, a higher weight gain indicates the presence of unprotected, i.e. uncoated, core. Stated differently, a higher weight indicates a lack of continuity in the protective shell, as the increased weight is believed to reflect the oxidation of the exposed ferromagnetic core. The temperature ramp employed in the TGA testing was 20° C./min, with a maximum temperature of 700° C. Uncoated samples of carbonyl iron exhibited a TGA weight gain of about 30%. In contrast, the silicon dioxide coated carbonyl iron sample prepared above exhibited a 3% increase in weight following TGA, indicating the presence of a substantially continuous protective shell.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method of producing coated particles, said method comprising:

providing a rotatable retort mounted about a generally horizontal axis of rotation and having an outer wall;

partially filling said retort by placing ferromagnetic particles selected from the group consisting of iron, carbonyl iron and alloys thereof into said retort;

evacuating said partially filled retort;

supplying a gaseous composition containing both silicon and oxygen as active elements at a controlled pressure within said evacuated retort;

rotating said retort during the supply of said gaseous composition to fluidize said ferromagnetic particles; and heating the exterior of said retort while said retort is rotating to transfer energy through said outer wall of said retort and into said ferromagnetic particles, thereby producing coated particles by effecting deposition of said active elements within said gaseous composition onto the surface of said ferromagnetic particles.

2. A coated particle capable of withstanding corrosive environments comprising:

a core comprising one or more layers, said core comprised of a ferromagnetic material selected from the group consisting of iron, carbonyl iron, cobalt, nickel, and alloys thereof, said core further defining an outer surface area, and a protective shell comprising one or more layers of at least one non-conducting material coated onto said outer surface area of said core, said protective shell shielding said core from oxidation and forming a substantially continuous layer;

wherein said core is substantially free of said non-conducting material, such that the ferromagnetic properties of said coated particle are comparable to an uncoated particle formed from the same ferromagnetic material, wherein the Curie point of said coated particle is approximately equal to the Curie point of said core, and further wherein said coated particle exhibits a weight gain of no greater than about 3 % as determined using thermogravimetric analysis with a temperature ramp of 20° C./min and a maximum temperature of 700° C.

3. A coated particle according to claim 2, wherein said substantially continuous layer ranges in thickness from about 0.05 microns to about 20 microns.

4. A coated particle capable of withstanding corrosive environments comprising:

a core comprising one or more layers, said core comprised of a ferromagnetic material selected from the group consisting of iron, carbonyl iron, cobalt, nickel, and alloys thereof, said core further defining an outer surface area, and a protective shell comprising one or more layers of at least one non-conducting material coated onto said outer surface area of said core, said protective shell shielding said core from oxidation and forming a substantially continuous layer, wherein said substantially continuous layer has a thickness of up to about 0.5 microns;

wherein said core is substantially free of said non-conducting material, such that the ferromagnetic properties of said coated particle are comparable to an uncoated particle formed from the same ferromagnetic material, and further wherein said coated particle exhibits a weight gain of no greater than about 3% as determined using thermogravimetric analysis with a temperature ramp of 20° C./min and a maximum temperature of 700° C.

5. A coated particle according to claim 2, wherein said non-conducting material has a resistivity greater than 2500 ohm-cm.

6. A coated particle according to claim 2, wherein said non-conducting material is selected from the group consisting of silicon, silicon dioxide, chromium oxide, aluminum oxide, and mixtures thereof.

7. A coated particle according to claim 2, wherein said core is selected from the group consisting of iron, carbonyl iron, and alloys thereof.

8. A coated particle capable of withstanding corrosive environments comprising:

a core comprising one or more layers, wherein said core is carbonyl iron, and wherein said core further defining an outer surface area, and a protective shell comprising one or more layers of silicon dioxide coated onto said outer surface area of said core, said protective shell shielding said core from oxidation and forming a substantially continuous layer;

wherein said core is substantially free of said non-conducting material, such that ferromagnetic properties of said coated particle are comparable to an uncoated particle formed from the same ferromagnetic material, and further wherein said coated particle exhibits a weight gain of no greater than about 3% as determined using thermogravimetric analysis with a temperature ramp of 20° C./min and a maximum temperature of 700° C.

9. A coated particle according to claim 2, wherein said particle has a shape selected from the group consisting of spheres, flakes and fibers.

10. A coating composition comprising:

(a) a polymeric binder, and (b) coated particles comprising (i) a core comprising comprised of a ferromagnetic material selected from the group consisting of iron, carbonyl iron, cobalt, nickel, and alloys thereof, said core further defining an outer surface area, and (ii) a protective shell comprising at least one layer of non-conducting material having a resistivity greater than 2500 ohm-cm, said non-conducting material coated onto said outer surface area of said core, said protective shell shielding said core from oxidation and forming a substantially continuous layer;

wherein said core is substantially free of said non-conducting material, such that the ferromagnetic properties of said coated particle are comparable to an uncoated particle formed from the same ferromagnetic material and said coated particle exhibits a weight gain of no greater than about 3% as determined using thermogravimetric analysis with a temperature ramp of 20° C./min and a maximum temperature of 700° C. and wherein said polymeric is binder present in an amount sufficient to bind said coating composition together while maintaining said coated particles substantially separate from each other.

11. A coating composition according to claim 10, further comprising conductive particles.

12. A coating composition according to claim 10, wherein said composition contains said coated particles in amounts ranging up to about 85 wt %.

13. A coating composition according to claim 10, wherein said polymeric binder comprises polyurethane.

14. An article useful in radar absorption that can withstand corrosive environments, said article incorporating the coated particles of claim 1.

15. A method of producing coated particles, said method comprising:

providing a rotatable retort mounted about a generally horizontal axis of rotation and having an outer wall;

partially filling said retort by placing a sufficient quantity of ferromagnetic particles into said retort;

evacuating said partially filled retort;

supplying a gaseous composition comprising one or more active elements selected from the group consisting of silicon, chromium, aluminum and oxygen at a selected controlled pressure within said evacuated retort;

rotating said retort during supply of said gaseous composition containing said one or more active elements at a speed sufficient to fluidize said ferromagnetic particles; and heating the exterior of said retort while said retort is rotating to transfer energy through said outer wall of said retort and to said ferromagnetic particles to effect the coating of said ferromagnetic particles with said one or more active elements within said gaseous composition.

16. A method according to claim 15, wherein said partially filling step further comprises placing a quantity of inert particles into said retort along with said ferromagnetic particles.

17. A method of producing coated particles, said method comprising:

providing a rotatable retort mounted about a generally horizontal axis of rotation and having an outer wall;

partially filling said retort by placing a sufficient quantity of ferromagnetic particles into said retort, said ferromagnetic particles defining an outer surface area;

evacuating said partially filled retort;

supplying a gaseous composition comprising one or more active elements selected from the group consisting of silicon, chromium, aluminum and oxygen at a selected controlled pressure within said evacuated retort in a quantity sufficient to form a coating having a thickness of at least about 0.05 microns on said outer surface area of said ferromagnetic particle;

rotating said retort during supply of said gaseous composition containing said one or more active elements at a speed sufficient to fluidize said ferromagnetic particles; and heating the exterior of said retort while said retort is rotating to transfer energy through said outer wall of said retort and to said ferromagnetic particles to effect the coating of said ferromagnetic particles with said one or more active elements within said gaseous composition.

18. A method of producing coated particles, said method comprising:

providing a rotatable retort mounted about a generally horizontal axis of rotation and having an outer wall;

partially filling said retort by placing a sufficient quantity of ferromagnetic particles into said retort;

evacuating said partially filled retort;

supplying a gaseous composition comprising one or more active elements selected from the group consisting of silicon, chromium, aluminum and oxygen at a selected controlled pressure within said evacuated retort, said gaseous composition further comprising an active gas selected from the group consisting of silanes, SiH4, $SiF_4$, and $SiCl_4$;

rotating said retort during supply of said gaseous composition containing said one or more active elements at a speed sufficient to fluidize said ferromagnetic particles; and heating the exterior of said retort while said retort is rotating to transfer energy through said outer wall of said retort and to said ferromagnetic particles to effect the coating of said ferromagnetic particles with said one or more active elements within said gaseous composition.

19. A method according to claim 18, wherein said silanes are selected from the group consisting of triethoxysilane, trimethoxysilane, and tetraethoxysilane.

20. A method according to claim 18, wherein said active gas is $SiF_4$ and said step of supplying said gaseous composition further comprises combining a sufficient quantity of silicon powder with a sufficient quantity of NaF.

21. A method of producing coated particles, said method comprising:

providing a rotatable retort mounted about a generally horizontal axis of rotation and having an outer wall;

partially filling said retort by placing a sufficient quantity of ferromagnetic particles into said retort;

evacuating said partially filled retort;

supplying a gaseous composition comprising one or more active elements selected from the group consisting of silicon, chromium, aluminum and oxygen at a selected controlled pressure within said evacuated retort;

rotating said retort during supply of said gaseous composition containing said one or more active elements at a speed sufficient to fluidize said ferromagnetic particles;

heating the exterior of said retort while said retort is rotating to transfer energy through said outer wall of said retort and to said ferromagnetic particles to effect the coating of said ferromagnetic particles with said one or more active elements within said gaseous composition;

and oxidizing said coated particle.

22. A method according to claim 21, wherein said oxidizing step further comprises the steps of:

evacuating said retort containing said coated particles;

supplying an oxidizing gas comprising an oxidative element at a selected controlled pressure within said evacuated retort containing said coated particles;

rotating said retort during supply of said oxidizing gas containing said oxidative element at a speed sufficient to fluidize said coated particles; and heating the exterior of said retort while said retort is rotating to transfer energy through said outer wall of said retort and to said coated particles in a quantity sufficient to effect oxidation of at least a portion of said one or more active elements diffused into said ferromagnetic particle.

* * * * *